US005608160A

United States Patent [19]

Chastonay

[11] Patent Number: 5,608,160

[45] Date of Patent: Mar. 4, 1997

[54] BALANCING GOLF CLUBS TO A COMMON PERIOD OF OSCILLATION BY BALANCING SUCH CLUBS TO A COMMON EQUIVALENT PENDULUM LENGTH

[76] Inventor: Herman A. Chastonay, 6455 Potomac, St. Louis, Mo. 63139

[21] Appl. No.: 627,740

[22] Filed: Apr. 2, 1996

[51] Int. Cl.[6] ..... A63B 53/00

[52] U.S. Cl. ..... 73/65.03; 473/292

[58] Field of Search ..... 73/65.03, 65.06; 473/287, 291, 292

[56] References Cited

U.S. PATENT DOCUMENTS

| | | | |
|---|---|---|---|
| 1,594,801 | 8/1926 | Stackpole | 73/65.03 X |
| 3,577,771 | 5/1971 | Solheim | 73/65.03 |
| 4,043,184 | 8/1977 | Sayers | 73/65.03 |
| 4,128,242 | 12/1978 | Elkins, Jr. | 473/291 |
| 4,203,598 | 5/1980 | Stuff et al. | 473/297 |
| 4,261,566 | 4/1981 | MacDougall | 73/65.03 X |
| 4,603,577 | 8/1986 | Johnson et al. | 73/65.03 |
| 4,674,324 | 6/1987 | Benoit | 73/65.03 |
| 5,094,101 | 3/1992 | Chastonay | 73/65.03 |
| 5,277,059 | 1/1994 | Chastonay | 73/65.03 |
| 5,285,680 | 2/1994 | Sun | 73/65.03 |
| 5,318,296 | 6/1994 | Adams et al. | 473/292 |
| 5,417,108 | 5/1995 | Chastonay | 73/65.03 |
| 5,515,717 | 5/1996 | White | 73/65.03 |
| 5,528,927 | 6/1996 | Butler et al. | 73/65.03 |

*Primary Examiner*—Elizabeth L. Dougherty
*Attorney, Agent, or Firm*—Haverstock, Garrett & Roberts

[57] ABSTRACT

A method for dynamically balancing any plurality of golf clubs wherein each club in the plurality of clubs is balanced to the same equivalent pendulum length, the present method being based upon simulating the dynamic characteristics associated with swinging any particular golf club by using the dynamic equations describing simple pendulum motion wherein the equivalent pendulum length of any particular golf club is represented by the equation $$EPL = \frac{Q + r}{2}$$

where EPL=the equivalent pendulum length of the club; Q=the shaft or center of percussion length of the club; and r=distance between the center of gravity of the club and the grip end thereof. The present method also automatically balances all clubs in any particular plurality of clubs to a common period of oscillation and represents a simpler, less time consuming method for dynamically balancing such clubs as compared to the method disclosed in Applicant's U.S. Pat. No. 5,094,101. Balancing a particular group or set of golf clubs in accordance with the present method will more accurately match the individual clubs in such particular set or grouping so that all such clubs will "swing" or "feel" alike.

13 Claims, 1 Drawing Sheet

BALANCING GOLF CLUBS TO A COMMON PERIOD OF OSCILLATION BY BALANCING SUCH CLUBS TO A COMMON EQUIVALENT PENDULUM LENGTH

The present invention relates to a method for balancing golf clubs and, more particularly, to a method for dynamically balancing golf clubs using equivalent pendulum length as the controlling parameter. Since simple pendulum motion takes into account many of the dynamic characteristics of balancing a golf club, and since the center of gravity location of a particular golf club, the radius of gyration, and the center of percussion location of a club are all inter-related in both the dynamic equations describing compound pendulum motion as well as simple pendulum motion, constant equivalent pendulum length balancing provides for a much simpler dynamic balancing of such clubs as compared to other known balancing methods including Applicant's methods for dynamically balancing golf clubs previously disclosed in Applicant's U.S. Pat. No. 5,094,101. Although the present method is not always as accurate as the method for dynamically balancing golf clubs set forth in Applicant's U.S. Pat. No. 5,094,101, the present method disclosed herein is sufficiently accurate so as to provide a greatly improved and satisfactory set of dynamically balanced golf clubs having improved performance, control, and handling characteristics as compared to other known prior art balancing methods. The present method discloses a novel method for calculating the equivalent pendulum length of any particular golf club and thereafter balancing any particular group or set of clubs to a constant equivalent pendulum length, which method is less time consuming as compared to Applicant's more involved and more accurate method for dynamically balancing golf clubs using radius of gyration as the controlling parameter as disclosed in U.S. Pat. No. 5,094,101. Modifying a particular group or set of golf clubs in accordance with the present method will make each club in the particular group so modified "feel" and "swing" alike.

BACKGROUND OF THE INVENTION

As explained in Applicant's U.S. Pat. No. 5,094,101, a wide variety of methods for weighting and balancing golf clubs are known and have been utilized to some extent in an effort to improve the overall performance, control and handling characteristics of a particular set of golf clubs. Any particular set of clubs includes a plurality of clubs each having a different club head weight, a different shaft length and, consequently, a different overall club weight. The combination of all of these factors requires a golfer to take a different stance and, in effect, a different swing when using each respective golf club. In order to be somewhat proficient at the game of golf, a golfer must therefore practice and attempt to master the various stances and swings associated with using any particular known set of golf clubs. As is well known, all golfers seem to have at least one particular club within any given set which they feel more comfortable with in using and swinging and in which they can more accurately control when hitting any particular golf shot. In total contrast, golfers avoid using other clubs within the same set of golf clubs because they never seem to swing those other clubs properly. Normally, golfers prefer using the shorter irons as proper use and control of these clubs are easier to achieve with some degree of regularity as compared to the longer irons and woods. It is therefore desirable to dynamically balance a particular group or set of clubs based upon the ease and comfortability with respect to swing, performance and control associated with a particular golfer's most preferred club.

Although Applicant's method for dynamically balancing golf clubs using radius of gyration as a controlling parameter as disclosed in U.S. Pat. No. 5,094,101 more accurately describes and simulates the dynamic characteristics associated with swinging a particular golf club and more accurately balances such golf clubs based upon both dynamic as well as static characteristics, such method is somewhat more time consuming and tedious to achieve. Also, golfers have difficulty relating to radius of gyration balancing since such term is somewhat abstract and has no particularly useful physical interpretation or meaning other than being a convenient way of expressing the moment of inertia of the mass of a body in terms of its mass and a length. In an effort to both simplify the overall balancing process and reduce the overall time involved in dynamically balancing golf clubs, Applicant has devised the present compromise method for dynamically balancing golf clubs using equivalent pendulum length instead of radius of gyration as the controlling parameter. The present method still achieves most, if not all, of the benefits and objectives of the dynamic balancing method disclosed in U.S. Pat. No. 5,094,101 including optimizing and improving the overall feel, swing and performance characteristics of a particular set of golf clubs.

Although both Elkins, Jr. U.S. Pat. No. 4,128,242 and Stuff et al U.S. Pat. No. 4,203,598 discuss the period of oscillation of a particular golf club when such club is swung in a pendulum style fashion, and, although Elkins, Jr. U.S. Pat. No. 4,128,242 specifically discloses correlating each club in a particular set such that each club has substantially the same period of oscillation, neither of these two prior art references disclose any method for accomplishing this task other than by empirically measuring or timing the period of oscillation of each respective club. For example, Elkins, Jr. specifically discloses a device in FIG. 5 of U.S. Pat. No. 4,128,242 for swinging two golf clubs together in a pendulum manner in order to compare their respective periods of oscillation. Similarly, the Stuff et al U.S. Pat. No. 4,203,598 likewise discusses suspending a golf club by gimbals at a pivot point approximately 5 inches from the grip end as shown in FIG. 6 of such patent so as to freely swing such golf club in a plane perpendicular to the club face. By so doing, it is possible to empirically determine or measure the period of oscillation of such club by timing each respective swing or oscillation. In fact, in determining the center of percussion using equations 25, 26 and 27 disclosed in the Stuff et al patent, the time constant T is in fact measured empirically by counting the number of complete oscillations n in a given time period t ($T=t/n$). No other means for computing the period of oscillation is disclosed or even suggested.

Typically, finding the pendulum length of a particular golf club entails swinging the golf club pendulum style as disclosed in both the Elkins, Jr. and Stuff et al references so as to determine the period of oscillation of such club. Once the period of oscillation is empirically determined, one can then use the period of oscillation equation to find the pendulum length of the club, namely, $$T = 2\pi\sqrt{\frac{l}{g}} \tag{1}$$

where

T=period of oscillation, or time required for one complete oscillation;

l=the pendulum length; and g=the gravitational constant (i.e., 32.2 ft/sec$^2$ or 386.4 in/sec$^2$).

As can be seen from the period of oscillation equation set forth above, the only variable in such equation is the pendulum length. Therefore, once the period of oscillation is determined, one can easily calculate the pendulum length of any particular golf club. As explained below, and based upon the assumption that the swinging motion of a golf club can be simulated by the dynamic equations associated with simple pendulum motion, Applicant has devised a simple mathematical equation to accurately approximate the pendulum length of any particular golf club without first determining the period of oscillation. The use of Applicant's equivalent pendulum length equation avoids the tedious and time consuming method of empirically determining the period of oscillation of any particular golf club by actually timing the same as disclosed in both the Elkins, Jr. and Stuff et al references.

SUMMARY OF THE INVENTION

The present invention teaches a method for dynamically balancing any plurality of golf clubs such that the equivalent pendulum length for all such clubs comprising such plurality is held constant. The present method is based upon the assumption that any particular-golf club, when free to rotate and swing under the influence of gravity about a fixed horizontal axis not passing through the center of gravity of such club, will move and swing as a simple pendulum. Since simple pendulum motion, with some modifications as explained below, sufficiently simulates the oscillating motion of a golf club for dynamic balancing purposes, the dynamic equations for describing such motion are used in the present balancing method. As a result, a more simplified method for dynamically balancing a particular golf club using equivalent pendulum length as the controlling parameter has been devised.

An ideal simple pendulum consists of a particle suspended by a weightless cord from an axis of rotation, the particle vibrating or swinging in a vertical arc under both the influence of gravity and the tension in the supporting cord. In such a situation, the particle or pendulum weight has a period of oscillation that depends only on the length of the cord. These ideal conditions are closely approximated by suspending a small heavy body 10 at the end of a light cord 12 from an axis of rotation 14 as illustrated in FIG. 1. In such an arrangement, the weight or body positions B and C represent respective positions of the body 10 along the arc of travel AD.

As referenced above, the period or time required for a complete oscillation from A to D and back to A again is represented by the equation $$T=2\pi\sqrt{\frac{l}{g}} \tag{1}$$

where

T=period or time required for a complete oscillation;

l=pendulum length measured from the axis of rotation to the center of gravity of the weight of the body; and g=the gravitational constant (i.e., 32.2 ft/sec$^2$ or 386.4 in/sec$^2$).

As shown in FIG. 1, in this particular simulation, the center of gravity, radius of gyration and the center of percussion of the weight or body 10 are all co-located at the same physical location. As a result, the pendulum length l is measured from the axis of rotation 14 to the center of gravity of the weight 10 as illustrated in FIG. 1. Since the period or time of oscillation defined in Equation 1 above is dependent solely upon the pendulum length l, once such pendulum length is known, the period of oscillation for a particular body such as the body 10 illustrated in FIG. 1 can be easily calculated.

The pendulum simulation illustrated in FIG. 1 does not completely accurately describe the dynamic characteristics associated with swinging a particular golf club because the shaft associated with any particular golf club is not accurately represented by the weightless cord 12 illustrated in FIG. 1. The shaft of any particular golf club has some weight associated with it which creates a center of gravity of the overall club which in turn makes the period of oscillation faster and the pendulum length of the club shorter than the overall shaft length as compared to the pendulum length associated with the ideal simple pendulum illustrated in FIG. 1. As a result, the weight of the golf club shaft must be taken into account in order to more accurately determine the pendulum length associated with any particular club.

If the body weight 10 illustrated in FIG. 1 is divided as illustrated in FIG. 2 into a main body weight 16 and a smaller or fractional weight 18, as the smaller fractional weight 18 is moved upwardly along the weightless cord 12, the overall center of gravity and radius of gyration of the combined bodies 16 and 18 will likewise move upwardly along cord 12. This results in a faster period of oscillation since the overall pendulum length of the weight combination 16 and 18 is shorter than the pendulum length associated with body weight 10 illustrated in FIG. 1. This means that the pendulum length of the weight combination 16 and 18 lies somewhere between the center of gravity of the main weight 16 and the center of gravity of the partial weight 18 as illustrated in FIG. 2. It has also been observed that as the partial weight 18 is increased in overall weight, or such weight 18 is moved even further upwardly along weightless cord 12, or if both of these conditions occur, the pendulum length of the weight combination 16 and 18 becomes even shorter. This reinforces the observation and hypothesis that the pendulum length of the weight combination 16 and 18 as illustrated in FIG. 2 will lie somewhere between the respective weights.

The pendulum model illustrated in FIG. 2 can be used as a stepping stone to approximate the simple pendulum motion of any particular golf club swing such as the golf club 20 illustrated in FIG. 3 wherein the main body weight 16 of FIG. 2 represents the weight of the club head 22 and the partial body weight 18 of FIG. 2 represents the weight of the club shaft 24. As the weight of the cord 12 (FIGS. 1 and 2) is increased and gradually changed to an extremely lightweight club shaft, the center of gravity of the overall club is pulled upward on the club head 22 unto the hosel and as the weight of the club shaft and grip is further increased, the center of gravity of the club will move further upward towards the axis 14. In FIG. 1, the pendulum length is the length of the cord 12 to the center of gravity of the weight 10. In FIG. 2, the pendulum length is the length of the cord 12 to some point on such cord which lies between the respective weights 16 and 18. In FIG. 3, it has been observed that the pendulum length of the overall club 20 lies somewhere between the center of gravity of the club head 22 and the center of gravity of the overall club 20. As explained and discussed in Applicant's U.S. Pat. No. 5,094,101 and as illustrated in FIG. 3, the distance r represents the distance from the axis of rotation 14 located at the terminal end portion of the shaft or grip to the center of gravity location of the overall club and the distance q represents the center of percussion length of the club measured from the axis of rotation 14 to the center of percussion of the club head 22. Since the center of gravity of the club head 22 coincides with or typically lies substantially close to the center of percussion of the club head, the center of percussion length Q can be used to closely approximate the distance from the axis of rotation 14 to the center of gravity of the club head 22. Since it is has been observed that the pendulum length of the overall club 20 lies somewhere between the center of gravity of the overall club and the center of gravity of the club head 22, and since both the center of gravity length r and the center of percussion length Q can be easily determined for any particular club, Applicant postulates that the equivalent pendulum length of any particular golf club can be determined by the following formula, $$EPL = \frac{Q + r}{2} \tag{2}$$

where

EPL=the equivalent pendulum length of any particular golf club;

Q=the shaft or center of percussion length of the club; and r=the distance between the axis of rotation and the center of gravity of the club.

Based upon the above assumptions and Equation 2, the above equation locates the pendulum length of a particular club halfway between the center of gravity location of the entire club 20 and the center of percussion length for such club. This approximation is sufficiently accurate for the purposes of the present method and the equivalent pendulum length of any particular golf club can now be easily determined. Once the equivalent pendulum length for a favorite or reference club has been calculated, other clubs in a particular set or grouping can be balanced to the same equivalent pendulum length by calculating a new anticipated center of gravity associated with each of the other clubs in such set based upon the selected equivalent pendulum length value. Once the new center of gravity locations are calculated by utilizing Equation 2 above, each club can be weighted and balanced about its new center of gravity location thereby producing a set or group of golf clubs weighted and balanced to the same equivalent pendulum length.

The present method for dynamically balancing any particular group of golf clubs based upon a constant equivalent pendulum length comprises the following steps:

(1) having a golfer select a reference golf club having all of the optimal parameters and performance characteristics for that particular golfer as set forth and explained in Applicant's U.S. Pat. No. 5,094,101 including ease and comfortability with respect to swing, performance and control of that particular club;

(2) through measuring and balancing, obtaining the shaft or center of percussion length, and the center of gravity location of the reference club as explained in U.S. Pat. No. 5,094,101;

(3) using the equivalent pendulum length equation $$EPL = \frac{Q + r}{2}$$

where

EPL=the equivalent pendulum length of the club,

Q=the shaft or center of percussion length of the club, and r=the distance between the axis of rotation and the center of gravity of the club, calculate the equivalent pendulum length for the reference club;

(4) determining the shaft or center of percussion length of each club to be balanced to the equivalent pendulum length of the reference club;

(5) using the equivalent pendulum length equation, calculate the new center of gravity location for each club to be balanced based upon the selected equivalent pendulum length of the reference club; and (6) balancing each such golf club to be balanced in a conventional manner at its new center of gravity location based upon the selected pendulum length.

Since the period or time of oscillation represented by Equation 1 is dependent solely upon the pendulum length, and substituting equivalent pendulum length for pendulum length, Equation 1 becomes as follows:

$$T = 2\pi\sqrt{\frac{EPL}{g}} \tag{3}$$

Since each club in the particular set or group of clubs to be balanced is in fact balanced at its new center of gravity location based upon the equivalent pendulum length of the reference club, the period of oscillation of each such club balanced in accordance with the present method will likewise be the same. As a result, the present method not only balances any given plurality of golf clubs to a common equivalent pendulum length, but it likewise also automatically balances all such clubs to a common period of oscillation. Using the present method, it is not necessary to calculate the period of oscillation of the particular reference club.

It is anticipated and recognized that any number of selected clubs out of a particular set of golf clubs may be balanced in accordance with the present invention to a selected equivalent pendulum length. For example, all of the irons in a particular set of golf clubs could be weighted and balanced to a specific equivalent pendulum length whereas all of the woods in the same set of golf clubs could be weighted and balanced to a different equivalent pendulum length. Other groupings of selected clubs out of a particular set of golf clubs could likewise be balanced to specific equivalent pendulum length values, as desired.

Although the present compromised method for dynamically balancing a set of golf clubs does not produce as accurate a balancing method as that disclosed in Applicant's U.S. Pat. No. 5,094,101, this much simpler method still produces a better matched set of golf clubs for ease of handling, performance, feel and comfortability as compared to most of the known balancing methods. Although Applicant's equivalent pendulum length equation may not precisely locate the pendulum length for any given golf club as explained above, the use of Applicant's equivalent pendulum length equation is well within an acceptable and usable tolerance limit and, as such, such a balancing method still produces a particular set or grouping of clubs which is more in tune with and more responsive to that particular golfer's needs and preferences thereby noticeably improving the uniformity of feel and swing control experienced by such golfer. The importance of the present invention lies in the fact that once a particular equivalent pendulum length is selected, the dynamic equations for simple pendulum length are used to correlate the center of percussion length of each respective club to the new center of gravity location based upon the selected equivalent pendulum length value. Applicant's approach to determining the equivalent pendulum length (EPL) of any particular club as evidenced by Equation 2 above and to matching a group of clubs to a particular common pendulum length is much faster than the empirical method of trying to match the periods of oscillation of two or more clubs as discussed above and as disclosed in the prior art. Modifying or balancing any plurality of clubs to the same equivalent pendulum length of a preferred or reference club will make all such clubs swing and feel alike.

It is therefore a principal object of the present invention to provide another method for dynamically balancing any plurality of golf clubs wherein a common equivalent pendulum length is used as the controlling parameter.

Another object is to provide a simpler, less time consuming method for dynamically balancing golf clubs using a common equivalent pendulum length as the controlling parameter as compared to the method disclosed in U.S. Pat. No. 5,094,101.

Another object is to teach a mathematical formula for closely approximating the equivalent pendulum length of any particular golf club.

Another object is to teach a method for dynamically balancing any plurality of golf clubs wherein some of said plurality of golf clubs are balanced to one specific equivalent pendulum length value, while other clubs in said plurality are balanced to another specific equivalent pendulum length value.

Another object is to provide a method for optimizing and improving the overall feel, swing and performance characteristics of a particular set or group of golf clubs.

Another object is to provide a method for dynamically balancing any golf club so as to more accurately match the individual clubs in a particular set or grouping so that all such clubs "swing" or "feel" alike.

These and other objects and advantages of the present invention will become apparent to those skilled in the art after considering the following detailed specification in conjunction with the accompanying drawings.

DETAILED DESCRIPTION OF THE INVENTION

The first step in the present method for dynamically balancing any particular set or plurality of golf clubs again involves having a golfer select a favorite or reference club having all of the optimal design parameters and performance characteristics important to that particular golfer as previously explained in Applicant's U.S. Pat. No. 5,094,101. This selection of an ideal reference club involves a subjective evaluation on the part of the golfer in determining what performance and handling characteristics are important to that particular golfer, and what particular club construction "feels" and "performs" best for that golfer. The selected reference club should take into account all of the preferred factors and characteristics important to that golfer including such parameters as the overall weight of the club, moment of inertia, center of percussion location, center of gravity location, preferred or optimal club length, the particular grip style and configuration preferred, and, most importantly, the ease, feel and comfortability with respect to swinging the reference club as well as its performance and control. Regardless of which club is selected as the reference club, it is important to remember that the above-referenced parameters with respect to the reference club is critical to the present balancing method since the reference club establishes the equivalent pendulum length value for the remaining clubs to be balanced and such equivalent pendulum length is a critical factor in how a club feels and performs.

Figure 1:
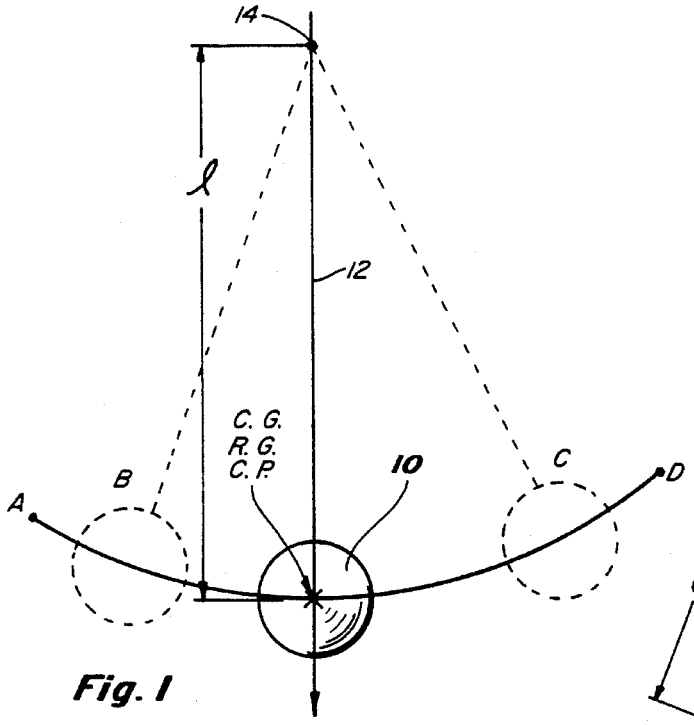
FIG. 1 illustrates the arrangement of a simple pendulum wherein the pendulum weight is suspended for arcuate motion at the end of a substantially weightless cord.
Figure 3:
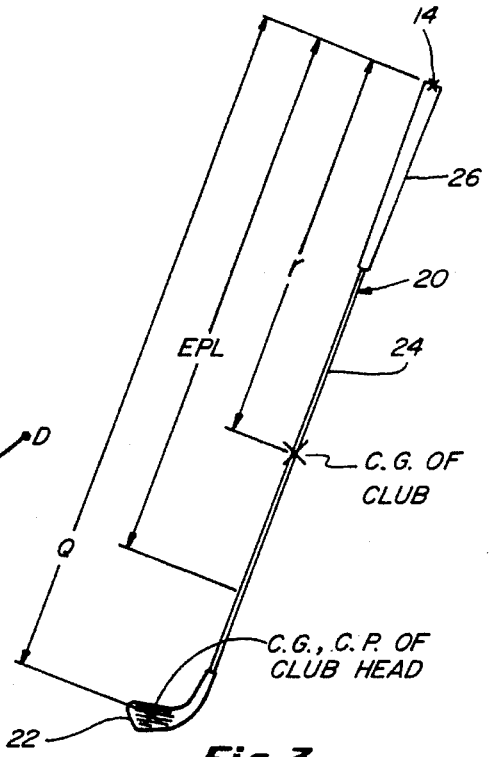
FIG. 3 is an illustration of a typical golf club suspended for simple pendulum motion from an axis of rotation wherein the location of the various parameters used in the present method for dynamically balancing a particular golf club are identified and illustrated therein.
Figure 2:
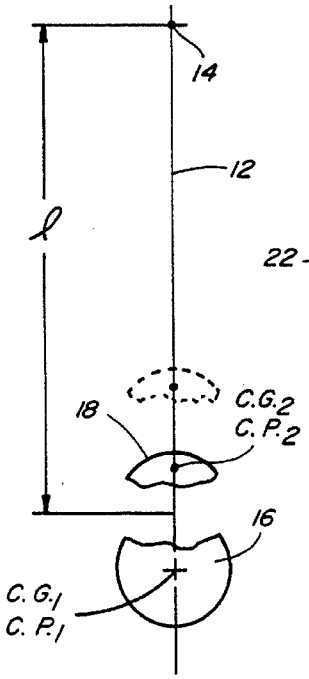
FIG. 2 is a depiction of a simple pendulum arrangement illustrating movement of the pendulum length as weight is attributed to or moved upwardly along the cord member.
Figure 4:
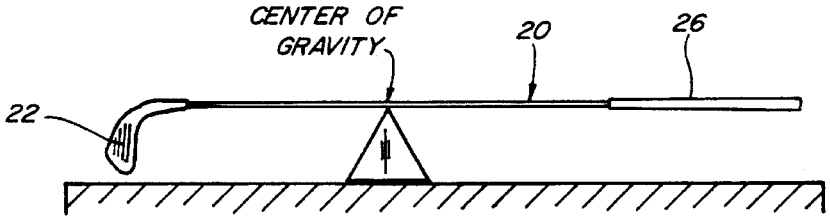
FIG. 4 is a side elevational view of a typical fulcrum device used to locate the center of gravity of a golf club along the shaft thereof.

Once the reference club has been selected in accordance with the guidelines set forth above and in U.S. Pat. No. 5,094,101, the reference club, such as the club 20 illustrated in FIGS. 3 and 4, is measured to determine its shaft or center of percussion length. As illustrated in FIG. 3, the shaft or center of percussion length is measured from the free end of the grip portion 26 to the center of percussion of the club head 22. If the location of the center of percussion of the reference club is not already known, such location must be determined by known means. The location of the center of percussion of any particular golf club can be determined as more fully explained in Applicant's U.S. Pat. No. 5,277,059. When the face of the club head 22 is struck such that the only motion imparted to the club head 22 is rotational or straight back motion, this location corresponds to the center of percussion for the selected golf club as explained in U.S. Pat. No. 5,277,059. Once the shaft or center of percussion length "Q" has been determined, the reference club 20 is balanced on a conventional fulcrum type device as illustrated in FIG. 4 in order to locate the center of gravity position for such club. When so balanced, the center of gravity location is marked on the club shaft and the distance "r" (FIG. 3) from the center of gravity location to the free end portion of the grip 26 is measured and determined. With respect to the selected reference club 20, we now know the shaft or center of percussion length "Q" and the distance "r" as illustrated in FIG. 3. Using the equivalent pendulum length equation $$EPL = \frac{Q + r}{2},$$

the equivalent pendulum length can now be calculated for the reference club 20. Having determined the equivalent pendulum length for the selected reference club, this equivalent pendulum length value will now be the basis for balancing all of the remaining clubs in any particular set or other club grouping.

The remaining club or clubs to be balanced can now be assembled and the shaft or center of percussion length associated with each such club is measured as previously described with respect to reference club 20. This now establishes the shaft or center of percussion length "Q" for each club in any particular plurality of clubs to be balanced. Again, using the equivalent pendulum length equation (Equation 2) as set forth above, the distance "r" representing the distance between the free end portion of the club shaft and the new anticipated center of gravity of the club based upon the selected equivalent pendulum length value determined for the reference club can now be calculated for each club to be balanced. Each such distance "r" represents the new center of gravity location associated with each of the respective clubs about which location each such club will now be balanced in order to produce a set or plurality of clubs each having an equivalent pendulum length equal to the equivalent pendulum length determined for the reference club 20.

Figure 5:
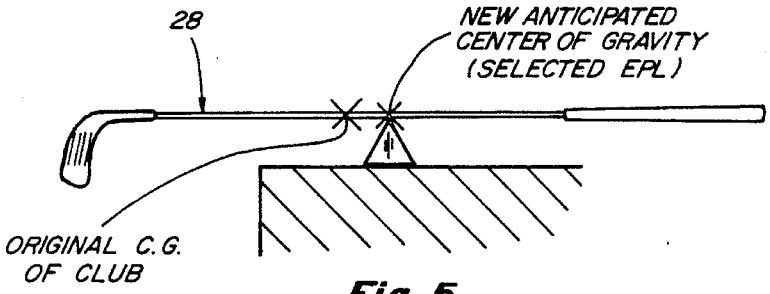
FIG. 5 is a side elevational view of a typical fulcrum device similar to FIG. 4 illustrating the weighting and balancing of a particular golf club at its new center of gravity location based upon a selected equivalent length value.

Each club to be balanced in accordance with the present method such as the golf club 28 shown in FIG. 5 is now balanced in a conventional manner at its new center of gravity location as calculated above and as illustrated in FIG. 5. This balancing is achieved as previously discussed in Applicant's U.S. Pat. No. 5,094,101 by generally adding trial weights adjacent the grip end portion of the club in order to balance such club in equilibrium about the new center of gravity location. If the particular club being balanced to the selected equivalent pendulum length value is, in fact, being balanced without the grip member attached thereto, a substitute weight simulating the weight of the grip member is positioned on the club shaft at the approximate location prior to balancing as explained in U.S. Pat. No. 5,094,101. Once the club is balanced as just described, a single permanent weight equal to the trial weight or any equivalent weight arrangement is positioned and secured preferably inside the club shaft at the same location as the trial weight as fully set forth and explained in Applicant's U.S. Pat. No. 5,094,101. The trial weight is then removed and the balance of the club with the permanent weight or weights secured thereto is then rechecked to ensure that the club has remained in balance. If, for any reason, the club remains out of balance when the permanent weights are attached thereto, the above-identified balancing process is repeated until complete balancing and equilibrium is achieved. At this point, the club is dynamically balanced to the same equivalent pendulum length of the reference club. If a simulated grip weight was used during the balancing process as explained in U.S. Pat. No. 5,094,101, the simulated weight can now be removed and the actual grip member is positioned and secured to the outer periphery of the club shaft. Again, once the grip member is attached to the club, the balance of the club should again be rechecked and, if necessary, re-balanced. Since the equivalent pendulum length was held constant, the re-balanced club now has the same desired, optimal performance and feel as the reference club.

Although the above method has been described with respect to a particular club 28, the present balancing method can be successively repeated for each club to be balanced in accordance with the techniques and teachings described above. When each individual club to be balanced has, in fact, been balanced about the new anticipated center of gravity location based upon the selected equivalent pendulum length value, each such club will be dynamically balanced to the same equivalent pendulum length. As previously explained, it is also recognized and anticipated that all of the irons associated with a particular set of golf clubs could be dynamically balanced to one equivalent pendulum length value whereas all of the woods associated with the same set of clubs could be balanced to a different equivalent pendulum length value, the reference club selected for the woods exhibiting different performance and feel characteristics as compared to the reference club selected for the irons. Still further, some of the irons may be balanced to one equivalent pendulum length value whereas other irons in the same set may be balanced to a different equivalent pendulum length value. In this regard, typically, it is not necessary to balance the higher irons such as the 7, 8 and 9 irons as well as the pitching wedge type clubs in accordance with the present method since these clubs are generally easier to swing and generally have equivalent pendulum lengths substantially close to the selected reference club. Nevertheless, depending upon the particular performance characteristics preferred by the individual golfer, any plurality of golf clubs can be balanced in accordance with the present method including the higher numbered irons and pitching type wedge clubs.

Also, although, in most cases, the club to be balanced such as club 28 illustrated in FIG. 5 will be weighted towards the grip portion of the club, it is further recognized and anticipated that, in some cases, depending upon the characteristics of the reference club selected by a particular golfer, additional weights may have to be added towards the club head portion of the club in order to bring such club into balance about the new anticipated center of gravity location. In such event, the permanent weights needed to bring such club into balance will have to be manipulated and located at the proper position on the club head in a manner that will retain the center of percussion at the center of the club face or at some other location previously selected. It is believed that dynamically balancing any plurality of clubs to the same equivalent pendulum length results in improved swing feel and control for such set of clubs thereby producing a noticeable improvement in the uniformity of feel or swing experienced by the golfer.

Table 1 below represents the parameters associated with the irons of a typical set of golf clubs. These irons were associated with a brand new set of golf clubs and had never been used.

TABLE 1

| CLUB | SWING WEIGHT READING | WEIGHT | Q | r | K | EPL | T |
|---|---|---|---|---|---|---|---|
| 3 | C-8 | 14 oz. | 39" | 28.375" | 33.26" | 33.54" | 1.851 sec |
| 4 | D-4½ | 14.6 oz. | 38⅝" | 28.5" | 33.18" | 33.43" | 1.848 sec |
| 5 | D-2½ | 14.6 oz. | 38½" | 28.375" | 33.0" | 33.29" | 1.844 sec |
| 6 | D-2½ | 14.7 oz. | 37½" | 28.25 | 32.54" | 32.76" | 1.830 sec |
| 7 | D-2½ | 15.0 oz. | 37" | 27.75" | 32.0" | 32.25" | 1.815 sec |
| 8 | D-1½ | 15.0 oz. | 36⅝" | 27.75" | 31.88" | 32.0" | 1.808 sec |
| 9 | C-9½ | 15.2 oz. | 38⅛" | 27.5" | 31.51" | 31.71" | 1.800 sec |
| W | D-½ | 15.3 oz. | 35½" | 27.375" | 31.17" | 31.34" | 1.789 sec |

As disclosed in Applicant's U.S. Pat. Nos. 5,094,101 and 5,417,108, the radius of gyration of any particular club can be calculated from the following formula:

$$Q=\frac{K^2}{r} \quad (4)$$

where

Q=the shaft or center of percussion length of the club,

K=the radius of gyration of the club, and r=the distance between the axis of rotation and the center of gravity of the club.

Since both the center of percussion length Q as well as the center of gravity distance r can be determined for any particular golf club as explained above, the radius of gyration for that particular club can likewise be calculated using the above radius of gyration formula. Also, using the equivalent pendulum length equation $$EPL=\frac{Q+r}{2},$$

the equivalent pendulum length for any particular club can likewise be calculated. In reviewing Table 1 above, it can be seen that the equivalent pendulum length (EPL) values for the irons depicted therein range from 31.34 inches to 33.54 inches. Similarly, the center of gravity lengths for the depicted irons range from 27.375 inches to 28.5 inches and the radius of gyration values range from 31.17 inches to 33.26 inches. Still further, it appears that the 3, 4 and 5 irons are balanced to a somewhat similar EPL value which is substantially higher than the EPL value associated with the generally preferred 7 iron. Importantly, note the differences associated with the period of oscillation time T associated with each of the depicted irons. These times are different for each club and range from 1.789 seconds to 1.851 seconds.

Using the data set forth above in Table 1 and selecting a reference club wherein the equivalent pendulum length EPL equaled 32.50 inches, the 3, 4, 5 and 6 irons set forth above in Table 1 were dynamically,balanced in accordance with the present method. Table 2 below represents the various parameters associated with the 3, 4, 5 and 6 irons as modified in accordance with the present balancing method. The 7, 8, 9 and pitching wedge irons set forth in Table 2 were not re-balanced and such parameters are identical to those set forth in Table 1 above.

TABLE 2

| CLUB | SWING WEIGHT READING | WEIGHT | Q | r | K | EPL | T |
|---|---|---|---|---|---|---|---|
| 3 | B-4½ | 14.3 oz. | 39" | 25.44" | 31.98" | 32.22" | 1.814 sec |
| 4 | B-9 | 15.2 oz. | 38⅝" | 25.68" | 31.89" | 32.15" | 1.812 sec |
| 5 | B-8½ | 15.0 oz. | 38½" | 25.77" | 31.75" | 32.13" | 1.812 sec |
| 6 | C-6½ | 14.8 oz. | 37½" | 27.0" | 31.8" | 32.3" | 1.817 sec |
| 7 | D-½ | 15.0 oz. | 37" | 27.75" | 32.0" | 32.25" | 1.815 sec |
| 8 | D-1½ | 15.0 oz. | 36⅝" | 27.75" | 31.88" | 32.0" | 1.808 sec |
| 9 | C-9½ | 15.2 oz. | 36⅛" | 27.5" | 31.51" | 31.71" | 1.800 sec |
| W | D-½ | 15.3 oz. | 35½" | 27.375" | 31.17" | 31.34" | 1.789 sec |

In reviewing Table 2 above, you will notice that the equivalent pendulum length value for the re-balanced 3, 4, 5 and 6 irons are substantially identical to each other ranging from 32.13 inches to 32.3 inches as compared to the selected EPL value of 32.5 inches. These EPL values are likewise substantially smaller than the EPL values associated with the original 3, 4, 5 and 6 irons. The only reason the EPL values of the re-balanced clubs are not identical to the selected EPL value of 32.5 inches is due to the limitations of Applicant in re-balancing such clubs. If proper instrumentation were available to Applicant, such clubs could theoretically be weighted and balanced such that the EPL values would be identical. However, in reality, slight variations in certain parameters will always exist, regardless of the instrumentation and/or balancing techniques used, due to the fact that weight balancing about a specific point such as a new anticipated center of gravity length will always result in some deviation or variation from the determined parameter values, no matter how small.

Nevertheless, a comparison of all of the EPL values associated with re-balanced irons 3–6 as well as the original EPL values associated with irons 7–9 and the pitching wedge club as set forth in Table 2 reveals that all of the EPL values associated with such clubs are now substantially closer to each other ranging from 31.34 inches to 32.3 inches. Similarly, the radius of gyration values associated with the re-balanced clubs are likewise substantially closer to each other verifying Applicant's hypothesis that the present method for dynamically balancing golf clubs to a common equivalent pendulum length likewise results in balancing such clubs to a substantially similar radius of gyration value. This means that the present method for balancing golf clubs, in effect, represents a substantially simpler method for accomplishing a radius of gyration balancing as disclosed in Applicant's U.S. Pat. No. 5,094,101. Still further, it should be noted that the period of oscillation times T associated with each of the clubs identified in Table 2 are now substantially closer to each other, the oscillation times associated with the re-balanced irons 3–6 now ranging from 1.812 seconds to 1.817 seconds as compared to the pre-balanced oscillation times which range from 1.810 seconds to 1.851 seconds. Again, if proper instrumentation were available to Applicant so as to balance the 3, 4, 5 and 6 irons to the same EPL value, the period of oscillation time T for each such re-balanced iron would likewise be identical. This further verifies Applicant's hypothesis that the equivalent pendulum length equation developed by Applicant, namely, $$EPL=\frac{Q+r}{2}$$

(Equation 2), is accurate and likewise balances all such clubs to a common period of oscillation.

It is also important to recognize that once a particular set of golf clubs are balanced in accordance with the present method using equivalent pendulum length as the controlling parameter, such re-balanced set of golf clubs can be utilized as a particular master or reference set of golf clubs and all such clubs can be placed on a conventional swing weight scale so as to determine the corresponding swing weight scale designation associated with each of the re-balanced clubs in the master set. Once this correlation between equivalent pendulum length value and swing weight scale designation has been established, an identical set of golf clubs could be swing weighted to the same identical swing weight scale designations associated with the master or reference set of golf clubs in accordance with the teachings set forth in Applicant's correlated swing weight method for dynamically balancing golf clubs as taught in U.S. Pat. No. 5,417,108. This assumes that each golf club in the particular set of golf clubs to be balanced is substantially identical in weight, length and weight distribution as compared to the corresponding master set. Such a balancing would theoretically produce a set or plurality of golf clubs dynamically balanced to the same equivalent pendulum length by balancing such golf clubs on a conventional swing weight scale device to their respective corresponding, correlated equivalent pendulum length/swing weight scale designation reading as taught in Applicant's U.S. Pat. No. 5,417,108. Therefore, instead of tediously calculating the new center of gravity locations for each of the remaining clubs to be balanced in any particular set or grouping of clubs and thereafter tediously balancing each of such remaining clubs on a conventional fulcrum device about their respective new center of gravity locations as illustrated in FIG. 5, the equivalent pendulum length/swing weight scale correlation method described above and as more fully explained in Applicant's U.S. Pat. No. 5,417,108 circumvents this more tedious and time consuming method for dynamically balancing golf clubs and enables one to even further simplify the equivalent pendulum length balancing process by balancing any remaining identical sets or pluralities of golf clubs to be balanced on a swing weight scale using the correlation just determined between the selected equivalent pendulum length value and the corresponding or correlated swing weight scale designation or reading for a master set of clubs.

Since the present method also allows one to keep track of the additional balance weight which must be added to the grip side of each club to be balanced in order to balance each such club to the selected equivalent pendulum length value, a correlation also exists between the selected equivalent pendulum length value and the amount of additional weight which must be added to the particular clubs to be balanced in order to dynamically balance such clubs to the selected equivalent pendulum length value. This correlation can be obtained for a particular master or reference plurality of golf clubs. Once this correlation between equivalent pendulum length value and additional balance weight has been established, an identical plurality of golf clubs could be balanced to the selected equivalent pendulum length value by adding the corresponding/correlated additional balance weight to the grip side of the particular club to be balanced. This assumes that each golf club in the particular plurality of golf clubs to be balanced is again substantially identical in weight, length and weight distribution as compared to the corresponding master set or plurality of clubs. Such a balancing would again theoretically produce a set or plurality of golf clubs wherein, when each such club is thereafter positioned on a fulcrum, each such club will be balanced at the new anticipated center of gravity length r previously determined for the corresponding club in the master or reference set of clubs. This correlated balancing method based upon adding weight to the grip side of each of the plurality of golf clubs to be balanced is likewise discussed and more fully explained in Applicant's U.S. Pat. No. 5,417,108.

Although a precise relationship between a swing weight scale designation, additional balance weight and a particular equivalent pendulum length value can be established for a particular plurality of golf clubs that are identical in length, weight and weight distribution, realistically, very few sets of golf clubs are identical to each other in length, weight and weight distribution and this inaccuracy will be reflected in varying swing weight scale readings and differences in equivalent pendulum length values. This is true in all of the known weighting and balancing techniques as well as in the present method of dynamically balancing golf clubs using equivalent pendulum length as a controlling parameter. Nevertheless, as indicated above, the present method is sufficiently accurate as compared to other known prior art balancing methods and teaches a more simplified method for accomplishing the stated objectives.

Thus, there has been shown and described a novel method for dynamically balancing golf clubs to both a common period of oscillation and a common equivalent pendulum length, which method fulfills all of the objects and advantages sought therefor. Many changes, modifications, variations, and other uses and applications of the present invention will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

What is claimed is:

1. A method for balancing a plurality of golf clubs, said method comprising the following steps:

(a) having a golfer select a reference club having an inherent center of gravity length, an inherent center of percussion length, and an inherent equivalent pendulum length;

(b) determining the equivalent pendulum length of the reference club;

(c) determining the center of percussion length of each of the clubs in said plurality of said clubs;

(d) determining the new anticipated center of gravity location for each of said plurality of clubs based upon the corresponding center of percussion length associated respectively therewith and the equivalent pendulum length determined for said reference club; and (e) balancing each of said plurality of clubs about its respective new anticipated center of gravity so as to give each of said clubs the same equivalent pendulum length as the reference club.

2. The method defined in claim 1 wherein each of said plurality of golf clubs includes a club shaft and a grip located adjacent one end portion of said club shaft, the equivalent pendulum length of said reference club being determined through the use of the equation $$EPL = \frac{Q + r}{2}$$

where EPL=the equivalent pendulum length of the club, Q=the center of percussion length of the club, and r=the distance from the center of gravity of the club to the grip end of the club.

3. The method defined in claim 2 wherein the new anticipated center of gravity location for each of said plurality of clubs is determined using the equivalent pendulum length equation set forth in claim 2.

4. The method defined in claim 1 wherein said reference club is an iron.

5. The method defined in claim 1 wherein said reference club is a wood.

6. An improved method for dynamically balancing a plurality of golf clubs wherein each of said plurality of clubs are balanced to the same equivalent pendulum length, said method comprising the following steps:

(a) selecting a predetermined equivalent pendulum length value;

(b) determining the shaft or center of percussion length of each club in said plurality of clubs;

(c) using the equation $$EPL=\frac{Q+r}{2}$$

where

EPL=the equivalent pendulum length of the club,

Q=the shaft or center of percussion length of the club, and r=the distance from the center of gravity of the club to the grip end, calculating the new anticipated center of gravity length r for each club in said plurality of clubs based upon the corresponding shaft or center of percussion length Q associated respectively therewith and the selected equivalent pendulum length value EPL; and (d) balancing each of said plurality of clubs at its respective new anticipated center of gravity location.

7. The method defined in claim 6 further comprising the following additional steps:

(a) placing each of said plurality of clubs balanced in accordance with the method set forth in claim 6 above on a calibrated fulcrum scale device and obtaining the corresponding swing weight scale designation for each such balanced club;

(b) obtaining a second plurality of golf clubs wherein each club in said second plurality of clubs corresponds substantially in length and weight with a corresponding club in said plurality of clubs defined in claim 6; and (c) balancing any one of the clubs in said second plurality of golf clubs on a calibrated fulcrum scale device to the same swing weight scale designation as determined for the corresponding club in said plurality of golf clubs defined in claim 6.

8. A method for balancing a plurality of golf clubs comprising the following steps:

(a) having a golfer select a reference golf club;

(b) determining the shaft or center of percussion length and the center of gravity location of said reference club;

(c) using the equation $$EPL=\frac{Q+r}{2}$$

where

EPL=the equivalent pendulum length of the club,

Q=the shaft or center of percussion length of the club, and r=the distance from the center of gravity of the club to the grip end, calculating the equivalent pendulum length for the reference club;

(d) determining the shaft or center of percussion length of each club in said plurality of clubs to be balanced;

(e) using the equation set forth above in step (c), calculating the new center of gravity location r for each club in said plurality of clubs to be balanced based upon the corresponding shaft or center of percussion length Q associated respectively with each such club as determined in step (d) above and the selected equivalent pendulum length EPL of the reference club; and (f) balancing each such club in said plurality of clubs at its new center of gravity location determined in step (e) above.

9. A method for balancing a plurality of golf clubs wherein each of said plurality of golf clubs is balanced to the same equivalent pendulum length, said method comprising the following steps:

(a) selecting a predetermined equivalent pendulum length value;

(b) selecting a reference plurality of clubs to be balanced to the selected equivalent pendulum length value;

(c) determining the shaft or center of percussion length associated with each club in said reference plurality of clubs;

(d) determining the new anticipated center of gravity location for each club in said reference plurality of clubs using the selected equivalent pendulum length value and the equation $$EPL=\frac{Q+r}{2}$$

where

EPL=the equivalent pendulum length of the club,

Q=the shaft or center of percussion length of the club, and r=the distance from the center of gravity of the club to the grip end;

(e) balancing each club in said reference plurality of clubs at its respective new anticipated center of gravity location;

(f) placing each of said reference plurality of clubs balanced in accordance with step (e) above on a calibrated fulcrum scale device and obtaining the corresponding swing weight scale designation for each such club;

(g) obtaining a second plurality of golf clubs wherein each club in said second plurality of clubs corresponds substantially in length and weight with a corresponding club in said reference plurality of clubs; and (h) balancing any one of the clubs in said second plurality of golf clubs on a calibrated fulcrum scale device to the same swing weight scale designation as determined for the corresponding club in said reference plurality of golf clubs.

10. A plurality of golf clubs each comprising a club shaft, a grip and a club head, each club in said plurality of clubs being balanced about a center of gravity location on said club shaft such that all of said clubs have the same equivalent pendulum length, said center of gravity location for each respective club being based upon the center of percussion length associated with each respective club and said equivalent pendulum length value, said equivalent pendulum length value being defined by the equation $$EPL=\frac{Q+r}{2}$$

where EPL=the equivalent pendulum length of the club, Q=the center of percussion length of the club, and r=the distance from the center of gravity of the club to the grip end.

11. A method for balancing a plurality of golf clubs comprising the following steps:

(a) balancing each of said plurality of clubs to the same equivalent pendulum length;

(b) determining said same equivalent pendulum length for each of said plurality of clubs from the equation $$EPL = \frac{Q + r}{2}$$

where EPL=the equivalent pendulum length of the clubs, Q=the center of percussion tenth of the club, and r=the distance from the center of gravity of the club to the grip end of the club.

12. A method for balancing a plurality of golf clubs wherein each of said plurality of golf clubs is balanced to the same equivalent pendulum length, said method comprising the following steps:

(a) selecting a predetermined equivalent pendulum length value;

(b) selecting a reference plurality of clubs to be balanced to the selected equivalent pendulum length value;

(c) determining the shaft or center of percussion length associated with each club in said reference plurality of clubs;

(d) determining the new anticipated center of gravity location for each club in said reference plurality of clubs using the selected equivalent pendulum length value and the equation $$EPL = \frac{Q + r}{2}$$

where

EPL=the equivalent pendulum length of the club,

Q=the shaft or center of percussion length of the club, and r=distance from the center of gravity of the club to the grip end;

(e) balancing each club in said reference plurality of clubs at its respective new anticipated center of gravity location;

(f) determining the amount of additional balance weight which was added to each of said reference plurality of clubs in order to balance each such club to the selected predetermined equivalent pendulum length value;

(g) obtaining a second plurality of golf clubs wherein each club in said second plurality of clubs corresponds substantially in length and weight with a corresponding club in said reference plurality of clubs; and (h) balancing any one of the clubs in said second plurality of golf clubs by adding additional weight to the grip side thereof, said additional weight being substantially identical to the balance weight added to the corresponding club in said reference plurality of golf clubs such that when said club is thereafter positioned on a fulcrum, such club will be balanced at the new anticipated center of gravity length r determined for the corresponding club in said reference plurality of golf clubs.

13. A method for balancing a golf club to a selected equivalent pendulum length, said method comprising the following steps:

(a) selecting a predetermined equivalent pendulum length value;

(b) determining the shaft or center of percussion length of the club to be balanced;

(c) using the equation $$EPL = \frac{Q + r}{2}$$

where

EPL=the equivalent pendulum length of the club,

Q=the shaft or center of percussion length of the club, and r=distance from the center of gravity of the club to the grip end, calculating the new center of gravity length r for the club to be balanced based upon the corresponding shaft or center of percussion length Q for such club as determined in step (b) above and the predetermined equivalent pendulum length value EPL as selected in step (a) above; and (d) balancing said club at its new center of gravity location determined in step (c) above.

* * * * *